United States Patent [19]

Rainer et al.

[11] Patent Number: 4,574,819

[45] Date of Patent: Mar. 11, 1986

[54] PROCESS FOR INCREASING THE FILLING POWER OF TOBACCO

[75] Inventors: Norman B. Rainer; Dean M. Siwiec, both of Richmond, Va.

[73] Assignee: Philip Morris Incorporated, New York, N.Y.

[21] Appl. No.: 593,452

[22] Filed: Mar. 26, 1984

[51] Int. Cl.[4] ..... A24B 3/18; A24B 15/30

[52] U.S. Cl. ..... 131/291; 131/901; 131/902; 131/903

[58] Field of Search ..... 131/291, 296, 901, 902, 131/903

[56] References Cited

U.S. PATENT DOCUMENTS

| | | | |
|---|---|---|---|
| 4,008,723 | 2/1977 | Borthwick et al. | 131/251 |
| 4,248,252 | 2/1981 | Lendvay et al. | 131/291 |
| 4,274,427 | 6/1981 | Lendvay | 131/293 |
| 4,336,814 | 6/1982 | Sykes et al. | 131/291 |
| 4,388,933 | 6/1983 | Rainer et al. | 131/293 |

*Primary Examiner*—V. Millin

*Attorney, Agent, or Firm*—Arthur I. Palmer; James E. Schardt; W. Edward Bailey

[57] ABSTRACT

Cut tobacco is treated with a supersaturated aqueous solution of calcium citrate and excess moisture is removed. The result is a significant increase in the filling power of the cut tobacco.

6 Claims, No Drawings

PROCESS FOR INCREASING THE FILLING POWER OF TOBACCO

BACKGROUND OF THE INVENTION

This invention relates to the art of increasing the filling powder of tobacco. More particularly, this invention relates to a process whereby the filling power of tobacco is increased by contacting the tobacco with supersaturated aqueous calcium citrate and then drying the tobacco by heating.

During curing, the moisture content of tobacco leaves is greatly reduced resulting in shrinkage of the leaf structure and a decrease in filling power. Additionally, the shredding or cutting techniques employed to convert cured tobacco leaves into filler may result in some lamination and compression of the tobacco, thereby decreasing the filling power even further. Many processes have been devised for increasing the filling power of cured tobacco for reasons well known in the art.

The heretofore known processes may be broadly characterized as expansion or stiffening. Expansion involves penetration or impregnation of the tobacco with impregnants (blowing or puffing agents), which when removed during the subsequent expansion step, generate elevated pressure in and expand the tobacco. Among the impregnants which have been employed are pressurized steam, air, water, organic solvents, ammonia, carbon dioxide, combinations of ammonia and carbon dioxide, and compounds capable of liberating a gas when subjected to chemical decomposition, as by heating. Among the means disclosed for removing the impregnant to expand the cell walls are a sudden reduction in pressure, freeze-drying, convection heating, radiant transfer (infrared) and the application of a microwave field.

It is also known in the art to increase the filling power of tobacco by stiffening the tobacco. Such stiffening treatment may be applied in conjunction with an expansion process to maintain the tobacco in its expanded state after removal of the impregnant. One such process involves impregnating the tobacco with a solution (usually aqueous) of multivalent metal or organic acid salts, and then drying the tobacco. The tobacco is expanded by means of the solvent and, upon drying, the various salts and ions bind to the pectinaceous materials naturally occurring within tobacco to stiffen the pectins and prevent the tobacco from returning to its original unexpanded form. An increase in filling power of 5 to 25% is reported. The multivalent metal and organic acid salts specifically disclosed for use in this process are calcium acetate, calcium gluconate, calcium levulinate, aluminum citrate, potassium titanium oxalate, aluminum sulfate, potassium aluminum sulfate, ammonium aluminum sulfate, magnesium sulfate, ammonium magnesium sulfate, ferrous sulfate, hydrated ammonium aluminum sulfate, hydrated potassium aluminum sulfate, hydrated aluminum sulfate, hydrated potassium titanium oxalate, and calcium sulfamate. The amount of the multivalent metal or organic acid salts applied to the tobacco ranges from 0.2% to 7.5% by weight of the dry tobacco.

Other stiffening agents known in the art include polyfunctional carboxylic acids, carbonyl chloride, aldehydes, diammonium phosphate, ketenes, lactones and aldehydic and keto sugars. To achieve significant increases in filling power with these stiffening agents, the use of high temperatures, non-aqueous volatile organic solvents, and expansion techniques are disclosed.

The addition of alkaline earth metal salts for improving smoking characteristics is known in the art. Generally, the salts constitute 0.1 to 0.5% by weight of the final product.

It is also known to improve the mildness of reconstituted tobacco by adding a combination of carbon and alkaline earth oxides, bicarbonates, or hydroxides to the filler. Calcium and magnesium compounds are said to give good results. The carbon and alkaline earth additives constitute 2 to 50% by weight of the final product.

DEFINITIONS

As used herein, the following terms have the indicated meanings.

Filling Power

The ability of tobacco to form a firm cigarette rod at a given moisture content. A high filling power indicates that a lower weight of tobacco is required to produce a cigarette rod of a given circumference and length than is required with a tobacco of lower filling power. Filling power is increased by stiffening tobacco, by expanding tobacco, and by increasing the surface roughness of the tobacco so as to increase interparticle friction.

Cylinder Volume (CV)

The volume that a given weight of shredded tobacco occupies under a definite pressure. The CV value is expressed as cc/10 g. To determine this value, tobacco weighing 10.000 g is placed in a 3.358 cm diameter cylinder and the cylinder is vibrated for 30 seconds on a "Syntron" vibrator. The tobacco is then compressed by an 1875 g piston 3.33 cm in diameter, for 5 minutes. The resulting volume of tobacco is reported as cylinder volume. This test is carried out at standard environmental conditions of 23.9° C. and 60% relative humidity (RH). A high cylinder volume indicates a high filling power.

Equilibrium Cylinder Volume ($CV_{eq}$)

The cylinder volume determined after the tobacco has been equilibrated by conditioning at 23.9° C. and 60% RH for 18 hours.

Oven-Volatiles Content (OV)

A value indicating the moisture content (or percentage of moisture) of tobacco. It is determined by weighing a sample of tobacco before and after treatment for three hours in a circulating air oven at 100° C. The weight loss as a percentage of initial weight is the oven-volatiles content. The weight loss is attributable to volatiles in addition to water but OV is used interchangeably with moisture content and may be considered equivalent thereto since, at the test conditions, not more than about 1% of the tobacco weight is volatiles other than water.

Equilibrium Oven-Volatiles Content ($OV_{eq}$)

The OV value determined after the tobacco has been equilibrated by conditioning at 23.9° C. and 60% RH for 18 hours.

Specific Volume (SV)

The volume of a predetermined amount of tobacco divided by the weight of the tobacco. The SV value is expressed as cc/g. The "$SV_{acetone}$" value may be determined by a simple application of the weight in air versus weight in liquid method according to which a one-gram sample of tobacco is placed in a porous container which is then weighed, submerged in acetone, and reweighed. The "$SV_{Hg}$" value is determined by placing a known weight of tobacco in a sealed chamber of known volume and weight and then evacuating the air in the chamber to a pressure of 1 torr. An amount of mercury is then admitted to the chamber in a manner to immerse the tobacco in the mercury at a low enough pressure to substantially prevent intrusion of mercury into the porous structure. The volume of mercury displaced by the immersed tobacco when the actual total pressure on the tobacco is about 1.45 psia is expressed as $SV_{Hg}$ in cc/g. Specific volume differs from cylinder volume in that the tobacco is not compressed and in that the SV measurement excludes the interparticle space or volume. As specific volume increases, filling power also increases.

Equilibrium Specific Volume ($SV_{eq}$)

The SV value determined after the tobacco filler has been equilibrated by conditioning at 23.9° C. and 60% RH for 18 hours.

Tobacco

The term as used herein includes: lamina filler, i.e., shredded, cured tobacco exclusive of the stems (or veins); reconstituted tobacco; and processed stems. The tobacco may be of any type, and may be cased or uncased. Burley, bright, Oriental and blends thereof are preferred.

SUMMARY OF THE INVENTION

The present invention relates to a process for increasing the filling power of tobacco by contacting the tobacco with supersaturated aqueous calcium citrate and then drying the tobacco by heating.

DESCRIPTION OF THE INVENTION

According to the present invention, a process is provided for increasing the filling power of tobacco by contacting the tobacco with supersaturated aqueous calcium citrate and then drying the tobacco by heating. The supersaturated calcium citrate is obtained as a transient water solution of the nearly water-insoluble salt by carefully titrating an aqueous citric acid solution with calcium carbonate to a pH of 3.4 to 3.8. The aqueous solution may additionally contain usual tobacco casing ingredients. The resultant solution is stable for about 20 minutes to two hours, whereupon a cementitious precipitate of calcium citrate is deposited.

The tobacco is lamina filler, reconstituted tobacco or processed stems. The tobacco is preferably lamina filler selected from the group consisting of Burley, bright and mixtures thereof. Since the process of the present invention may be effectively employed with either cased or uncased tobacco, flavors and additives may be applied to the tobacco either prior to or subsequent to treatment. The calcium citrate may be applied to the tobacco while dispersed within a casing solution. It is preferred that the tobacco be lamina filler having an OV value within the range of from about 5% to about 35% before treatment.

When tobacco is cut or shredded to produce a lamina filler, it typically leaves the cutter at a moisture content (OV value) within the range of from about 18% to about 30%. This moisture content is appropriate for use in the present invention, and thus, the filling power of cut filler may be increased according to the process of the present invention without first reducing or increasing its moisture content.

The tobacco is contacted with calcium citrate in an amount such that the tobacco contains from about 0.5% to about 6% of the compound on a dry weight basis, and more preferably, from about 1% to about 3%. After being treated with calcium citrate, the tobacco is heated at a temperature and for a time sufficient to eliminate excess moisture.

The tobacco may be dried by substantially static or substantially dynamic methods. Static methods of drying involve the heating of relatively large masses of tobacco under relatively stationary conditions at temperatures from about 80° to about 100° C. for periods of time from about 15 minutes to about two hours. One suitable apparatus for bulk drying is a conveyor belt oven supplied with dry steam; another is described in U.S. Pat. No. 3,357,436. Dynamic methods of drying involve the rapid heating of smaller portions of tobacco moving rapidly through a heated zone of very high temperature. Typically, the zone will be a tubular conduit supplied with a flow of heated gas to convey the tobacco through the conduit at high velocity. Temperatures in the range of about 250° to about 370° C. may prevail within the zone, and the residence time of tobacco therein will be in the range of about 0.3 to about 4 seconds. It is understood that heating at a lower temperature will require a longer heating time, and vice versa. The tobacco may be heated by any conventional means known to those skilled in the art.

The process of the present invention results in an increase in the $CV_{eq}$ value of the tobacco. Increases in $CV_{eq}$ of from about 10% to about 25% have been realized.

The SV value of the tobacco is substantially unaffected by the process of the present invention, and therefore, the increase in filling power is not attributable to an expansion of the tobacco. It is a surprising aspect of the present invention that the filling power of tobacco is significantly increased by simple application of supersaturated calcium citrate. Although not wishing to be bound by theoretical explanations, we feel that the increase in $CV_{eq}$ produced by the process of this invention is attributable to a stiffening of the tobacco, and/or to an increase in interparticle bonding. Supplementary process steps, which cause expansion, may, however, be employed as well.

The treated tobacco obtained according to the present invention may be used alone or it may be mixed with other tobaccos to provide a blend for use in cigarettes or other smoking articles. Subjective evaluation has revealed that the calcium citrate added to the tobacco does not detract from the taste.

EXAMPLES

The following examples present illustrative but nonlimiting embodiments of the present invention. Comparative samples are also presented.

EXAMPLE 1

To sixty grams of bright casing solution contained in a beaker and given continuous agitation with a magnetic stir bar, there were added 1.34 grams of $Ca(OH)_2$ powder, 15 grams of $CaCO_3$ powder, and 22.0 grams of citric acid dissolved in 60 ml of water. Upon completion of effervescence, the mixture was filtered through a Whatman grade 54 filter paper. The resultant clear solution had a pH of 3.47 and a solids content of about 19.3%. If allowed to stand quiescent for 15 hours, it formed a precipitate of calcium citrate, $Ca_3(C_6H_5O_7)_2.4H_2O$.

Uncased bright filler (150 g) was treated with 39.0 g of the above freshly prepared solution, the treatment being uniformly achieved by tumbling the tobacco in a small rotating drum while being sprayed with the solution using an atomizing nozzle. By calculation, the amount ot calcium citrate thereby applied to the tobacco was 5% by weight of the tobacco. The treated tobacco was then dried and re-equilibrated at 75° F. and 60% RH. Following moisture re-equilibration, the treated sample and a control which had been treated with the same amount of casing solution minus the calcium citrate were tested for filling power by the cylinder volume test.

The following test data were obtained:

| | O.V. | C.V. |
|---|---|---|
| Treated Sample | 13.09 | 35.0 |
| Control | 13.00 | 31.0 |

As the results of this example indicate, the modification of the casing solution results in about a 13% increase in the cylinder volume of the tobacco.

An attempt was made to directly dissolve calcium citrate into the original casing solution. None would dissolve. Attempts were made to add sufficient $Ca(OH)_2$ and $CaCO_3$ in preparing the treatment solution to elevate its pH. It was found however, that at pH levels above 3.8, the solution was unstable and precipitated substantially its entire content of calcium citrate.

EXAMPLE 2

By the general procedures of Example 1, a solution was prepared by mixing 120 ml water with 22 g citric acid, then adding 15 g $CaCO_3$. After cessation of effervescence, the solution was filtered. The clear filtrate solution was found to have a pH of 3.69 and a solids content of 19.1%.

Thirty-nine grams of the freshly prepared solution was sprayed uniformly into 150 g of the same uncased bright filler tobacco employed in Example 1. The treated tobacco, having a calcium citrate add-on of 5%, was oven-dried at 70° C., then re-equilibrated to normal moisture regain. A control sample of the same tobacco (150 g) was sprayed with 32 g of water and similarly dried and re-equilibrated.

| | Test Results | |
|---|---|---|
| | O.V. | C.V. |
| Treated Sample | 11.26 | 41.0 |
| Control | 11.28 | 37.6 |

The treatment of this Example is seen to increase the C.V. of the tobacco by about 10%.

EXAMPLE 3

The solution of Example 1 (39 g) was sprayed onto 150 g of the tobacco of Example 1 which had been dry-blended with 2% by weight of $Ca(OH)_2$ powder. The resultant tobacco exhibited an increase in C.V. of 10% in comparison with an untreated specimen of the same tobacco as the same equilibrium O.V. of 12.26%.

EXAMPLE 4

Thirty-nine grams of the solution of Example 1, further modified by the addition of 3 drops of a silicone surfactant (Silwet ®L-77, sold by the Union Carbide Co.) was sprayed onto 150 grams of the tobacco of Example 1 containing 2% of $Ca(OH)_2$ powder by virtue of a prior dry blending operation. The resultant tobacco exhibited an increase in C.V. of 11.6% in comparison with an untreated specimen of the same tobacco at the same equilibrium O.V. of 12.9%.

EXAMPLE 5

Thirty-nine grams of the solution of Example 1, further modified by the addition of 5 g of absolute ethanol (for the purpose of lowering surface tension of the solution), was sprayed onto 150 g of the tobacco of Example 1. The resultant tobacco exhibited an increase in C.V. of 10% in comparison with an untreated specimen of the same tobacco at the same equilibrium O.V. of 13.09%.

EXAMPLE 6

Ten pounds of bright strip tobacco was sprayed with the solution of Example 1 to provide an add-on of calcium citrate of about 4.5%.

Following cutting, oven-drying and re-equilibration, the treated tobacco had about a 12% increase in C.V. in comparison with a tobacco similarly tested with a casing solution diluted with water and containing no calcium citrate.

A similar improvement in C.V. was secured when the drying of the cut tobacco was rapidly achieved by passing the treated tobacco at high velocity through a heated column.

EXAMPLE 7

A sheet of reconstituted tobacco (having been made by a papermaking process) was uniformly spray-treated on both sides with the solution of Example 2 so as to have a calcium citrate add-on of 3%. The treated sheet was oven-dried and converted to shredded form. Following re-equilibration with moisture, the treated shreds were found to have a 15% increase in C.V. value in comparison with material similarly treated with water.

EXAMPLE 8

A solution was prepared by mixing 185 ml water with 22 g citric acid, then adding 15 g $CaCO_3$. After cessation of effervescence, the resultant turbid solution was filtered. The clear filtrate solution thereby produced was found to have a pH of 3.71 and a solids content of 12.1%.

Two-hundred grams of the aforesaid solution was sprayed uniformly into one pound of uncased bright cut tobacco lamina having a starting OV of 11.2%. The calculated add-on of calcium citrate is 6%, based upon the dry weight of the tobacco.

The sprayed tobacco, having an approximate OV of 50%, and having a wet appearance due to its saturation content of water, was subjected to vacuum treatment of 3 mm Hg pressure for 30 seconds at 21° C. Upon restoration to ambient pressure, the wet appearance was lost, presumably because the liquid previously on the exterior has entered the interior of the tobacco.

The treated tobacco was dried to 25% OV under static conditions in a conventional tray dryer utilizing circulating air at 100° C. Completion of the drying was achieved under dynamic conditions using a tower of 3 inches I.D. and approximately 12 feet vertical height. The tobacco was entered into said tower at a rate of 3 g/second and was entrained by a current of steam having a temperature of 343° C. and a velocity of 33 m/sec. The emergent dried tobacco, after re-equilibration with moisture, was tested for CV and OV. A control sample, having been treated with plain water instead of the calcium citrate solution, and otherwise processed in the same manner, was also tested for CV and OV.

| | Test Results | |
|---|---|---|
| | O.V. | C.V. |
| Treated Sample | 11.5 | 68.9 |
| Control | 11.9 | 55.6 |

The treatment of this Example is seen to increase the CV of the tobacco by about 24%.

The stability of an aqueous solution of calcium citrate is dependent upon pH and concentration. At useful concentrations in the range of 10%–25%, the maximum pH for achieving solution stability of over one hour is about 4.0. When the concentration is reduced, higher pH values can be tolerated; however, the less concentrated solutions are not so effective because of the large amounts that would be required to spray onto tobacco to obtain a useful add-on of Ca citrate in the range of about 0.5% to 6%.

We claim:

1. A process for increasing the filling power of cut tobacco comprising:

treating the tobacco with a supersaturated aqueous calcium citrate solution in an amount effective to provide 0.5 to 6% citrate residue based on the tobacco and then heating the tobacco to drive off excess moisture.

2. The process of claim 1 wherein the citrate solution is sprayed or sprinkled on the tobacco.

3. The process of claim 1 wherein the citrate solution contains a tobacco casing ingredient.

4. The process of claim 1 wherein the citrate solution contains a surface tension lowering ingredient.

5. The process of claim 1 wherein the tobacco is heated at a temperature within the range of from about 70° C. to about 100° C.

6. A cut tobacco product prepared by the process of claim 1.

* * * * *